US009631783B2

(12) United States Patent
Tremblay

(10) Patent No.: US 9,631,783 B2
(45) Date of Patent: Apr. 25, 2017

(54) LIGHTING STRUCTURE

(71) Applicant: Jacques Tremblay, Saint-Hubert (CA)

(72) Inventor: Jacques Tremblay, Saint-Hubert (CA)

( * ) Notice: Subject to any disclaimer, the term of this patent is extended or adjusted under 35 U.S.C. 154(b) by 69 days.

(21) Appl. No.: 14/392,054

(22) PCT Filed: Jan. 17, 2014

(86) PCT No.: PCT/CA2014/000037

§ 371 (c)(1),
(2) Date: Jun. 19, 2015

(87) PCT Pub. No.: WO2014/113871

PCT Pub. Date: Jul. 31, 2014

(65) Prior Publication Data

US 2016/0003427 A1 Jan. 7, 2016

(30) Foreign Application Priority Data

Jan. 23, 2013 (CA) ..... 2805661

(51) Int. Cl.

| | |
|---|---|
| ***F21V 21/00*** | (2006.01) |
| ***F21S 4/00*** | (2016.01) |
| ***F21V 17/16*** | (2006.01) |
| ***F21S 4/28*** | (2016.01) |
| *F21Y 101/00* | (2016.01) |
| *F21Y 103/10* | (2016.01) |
| *F21Y 115/10* | (2016.01) |

(52) U.S. Cl.
CPC ..... *F21S 4/008* (2013.01); *F21S 4/28* (2016.01); *F21V 17/164* (2013.01); *F21Y 2101/00* (2013.01); *F21Y 2103/10* (2016.08); *F21Y 2115/10* (2016.08)

(58) Field of Classification Search
CPC ..... F21S 4/008; F21V 17/164
USPC ..... 362/217.01, 217.1, 217.14, 223, 249.01, 362/249.06
See application file for complete search history.

(56) References Cited

U.S. PATENT DOCUMENTS

| | | | | |
|---|---|---|---|---|
| 2005/0265019 | A1* | 12/2005 | Sommers | A47F 3/001 362/217.16 |
| 2008/0192462 | A1* | 8/2008 | Steedly et al. | 362/218 |
| 2011/0058357 | A1* | 3/2011 | Anderson | 362/125 |

* cited by examiner

*Primary Examiner* — Andrew Coughlin
*Assistant Examiner* — Meghan Ulanday
(74) *Attorney, Agent, or Firm* — Eric Fincham

(57) ABSTRACT

A lighting structure for mounting a strip of LED's comprising a base member (10) having a channel (15) formed therein for receiving the strip (54) of LED's, a first member (22) of an attachment system extending along a portion of the base member (10), and a cover (34) having a second portion (42, 46) of an attachment system, said second portion (42, 46) of said attachment system mating with the first portion (22) of the attachment system to retain the cover (34) and base member (10) together and at least partially overlapping the channel to permit retention of the strip of LED's therein.

12 Claims, 3 Drawing Sheets

LIGHTING STRUCTURE

FIELD OF THE INVENTION

The present invention relates to a lighting system and more particularly, relates to a lighting system using light emitting diodes (LED's) mounted in a strip.

BACKGROUND OF THE INVENTION

The use of light emitting diodes (LED's) is well known in the art. The technology relating to the manufacture of LED's is continuing to advance resulting in LED's having an increased light output. The use of LED's for lighting is considered desirable since the light output for a given unit of power is substantially greater than other forms of lighting such as incandescent and fluorescent.

One form in which LED's are now manufactured comprises a linear strip of the same. These strips are flexible and can be manufactured to operate on a relatively low voltage. However, the use of such strips of LED's can be problematic in that they need some means for attaching the strip to a substrate.

SUMMARY OF THE INVENTION

It is an object of the present invention to provide a holder or housing for a strip of LED's in order to permit mounting thereof in a desired location.

According to one embodiment of the present invention, there is provided a lighting structure for mounting a strip of LED's, the lighting structure comprising a base member, a channel formed within the base member for receiving the strip of LED's, a first portion of an attachment system extending along at least a portion of the base member, and a cover, the cover having a second portion of an attachment system, the second portion of the attachment system mating with the first portion of the attachment system to retain the cover and the base member together, the cover at least partially overlapping the channel to permit retention of the strip of LED's therein.

According to a further embodiment of the present invention, there is also provided a lighting structure comprising a strip of LED's, a base member, a channel formed within the base member, the strip of LED's being mounted in the channel, a first portion of an attachment system extending along at least a portion of the base member, a cover, the cover having a second portion of an attachment system, the second portion of the attachment system mating with the first portion of the attachment system to retain the cover and the base member together, the cover at least partially overlapping the strip of LED's to thereby retain the strip of LED's in the channel.

According to a further embodiment of the present invention, there is also provided a method of providing lighting to a desired area comprising the steps of supplying a lighting structure comprising a base member having a channel for receiving a strip of LED's, an attachment system, a first member of an attachment system extending along at least a portion of said base member, a cover having a second portion of an attachment system, placing said strip of LED's in said channel of said base member, securing said cover to said base member, and mounting said lighting structure in said desired location.

The lighting structure of the present invention is one which can be used in many different locations. One such location is for use on vehicles. Frequently, lighting is needed on a vehicle such as a truck in certain locations and though low voltage lighting is available, the power consumption is substantial and if the battery is not being recharged, battery failure is possible. The trucks can be of many different types and the lighting can be used for either practical or aesthetic purposes.

One can also envisage the use of low voltage lighting on other vehicles such as marine vehicles. The lighting would permit its use even when the generator/alternator is not charging the battery. Similarly, the lighting structure of the present invention could be utilized for around marine docks and the like particularly when using waterproof LED strips.

The lighting structure could also be used at many commercial locations as it allows lighting at a relatively low cost. Other applications would include residential where the lighting could be mounted in cupboards, underneath cupboards, and the like. It suffices to say that the lighting structure of the present invention is not limited to any one use, but may enjoy multiple uses.

The present invention illustrates a holder which may retain one or two strips of LED's. It will be understood that the mention is not limited to one or two strips of LED's, but that many strips might be utilized. Similarly, the present invention contemplates a holder or housing which may be formed of a plastic material which may either be rigid or flexible. However, other materials including metallic materials could also be utilized.

BRIEF DESCRIPTION OF THE DRAWINGS

Having thus generally described the invention, reference will made to the accompanying drawings illustrating an embodiment thereof, in which.

DETAILED DESCRIPTION OF THE INVENTION

Figure 1:
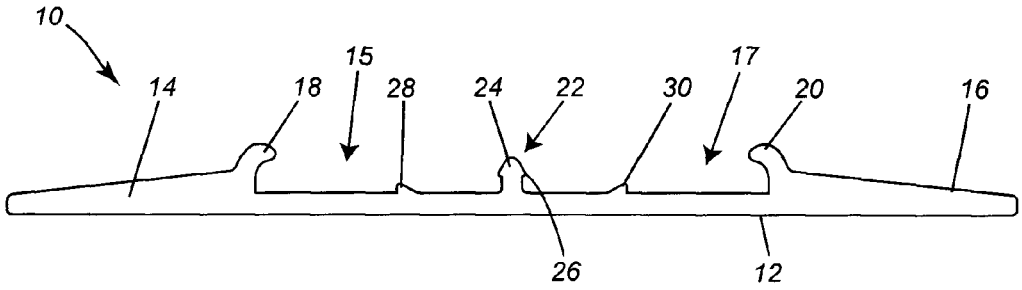
FIG. 1 is a cross-sectional view of a base member for retaining a double roll of LED's.

Referring to the drawings in greater detail and by reference characters thereto, there is illustrated in FIG. 1 a device for retaining a pair of rolls or strips of LED's. In particular, FIG. 1 illustrates a base member generally designated by reference numeral 10 and which has a flat bottom 12 for placing adjacent to a substrate. Base member 10 includes a first wing 14 and a second wing 16 located at side extremities of the base member 10.

Formed interiorly of wing 14 is a retaining lip 18 for retaining a first side of a LED strip as will be shown hereinbelow. A second retaining lip 20 is located adjacent wing 16 is also used for retaining a first side of a strip of LED's.

Formed centrally of the base member 10 and intermediate wings 14 and 16 is a center prong 22. Center prong 22 has an arcuate arrow shaped distal portion 24 which merges with the main portion of prong 22 by means of an undercut 26. A protrusion 28 extends upwardly from base member 10 intermediate retaining portion 18 and center prong 22; likewise, a protrusion 30 extends upwardly from base member 10 intermediate wing 16 and retaining portion 20. Channels 15 and 17 are defined by retaining members 18, 20 and center prong 22.

Figure 2:
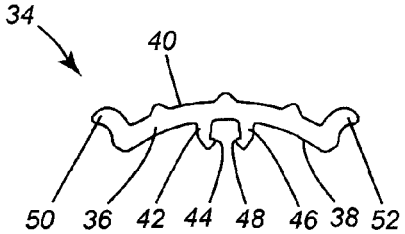
FIG. 2 is a cross-sectional view showing a cap to be utilized with the base member of FIG. 1.

A cap generally designated by reference numeral 34 is illustrated in FIG. 2. Cap 34 has an arcuate body 36 with a concave lower surface 38 and a convex upper surface 40. Extending downwardly from lower surface 38 is a first prong 42 having inwardly extending lip 44 and spaced therefrom is a second prong 46 also having an inwardly extending lip 48. At either end of arcuate body 36 there is provided a first upward retaining member 50 and a second upward retaining member 52.

Figure 3:
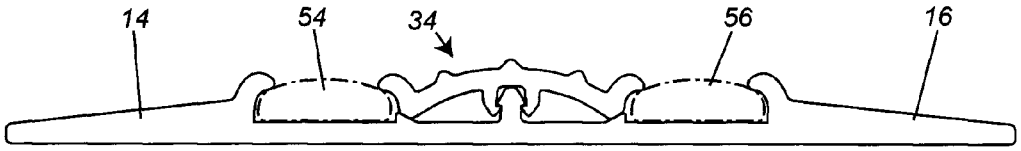
FIG. 3 is a cross-sectional view of the assembled base and cap.

The assembly of the cap 34 and base member 10 is illustrated in FIG. 3 wherein a first LED strip 54 is placed between retaining portion 18 and protrusion 28 in channel 15 while a second LED strip 56 is placed between protrusion 30 and retaining portion 20 in channel 17. Cap 34 is then placed on top such that upwardly retaining members 50 and 52 contact LED strips 54 and 56 respectively. Cap 34 is retained in position by means of prongs 42, 46 engaging center prong 22.

Figure 4:
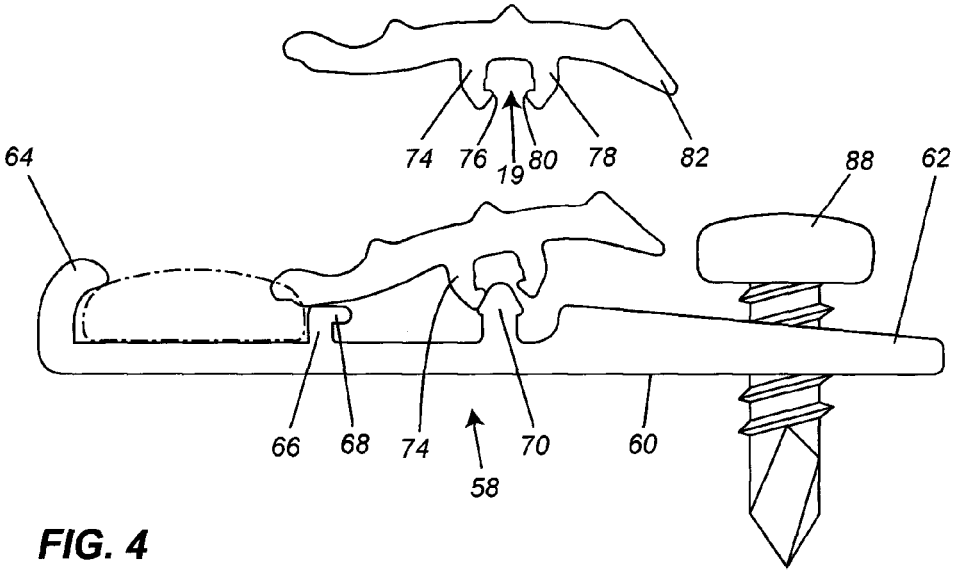
FIG. 4 is a cross-sectional view of a cover and cap for retaining a single roll of LED's.

An alternative embodiment is illustrated in FIG. 4 and reference will now be had thereto. In this embodiment, the base member is designated by reference numeral 58 and includes a flat bottom 60 again for engagement with a flat substrate. A single wing 62 is provided at one side thereof, while a retaining portion 64 is located on the other side. Protrusion 66 has a flange 68 extending outwardly therefrom. As in the previously described embodiment, a prong 70 is located centrally.

A cap 72 with first prong 74 having lip 76 and a second prong 78 having lip 80 defining a recess 19 is designed to engage upwardly extending prong 70. As will be noted, in this embodiment, there is provided a relatively short wing 82 through which the base 58 may be secured by means of screw 88 extending through aperture 87 as would be the case with the first embodiment.

Conventional electrical connections (not shown) can be utilised. As well, the holder may be formed of any suitable material such as metallic and/or plastic materials.

Figure 5:
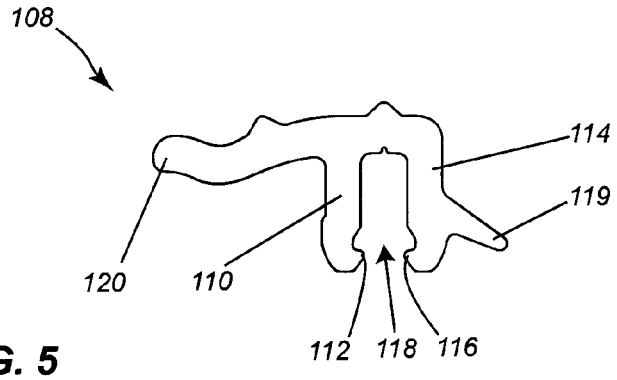
FIG. 5 is a cross-sectional view of a further embodiment of a cover according to the present invention.
Figure 6:
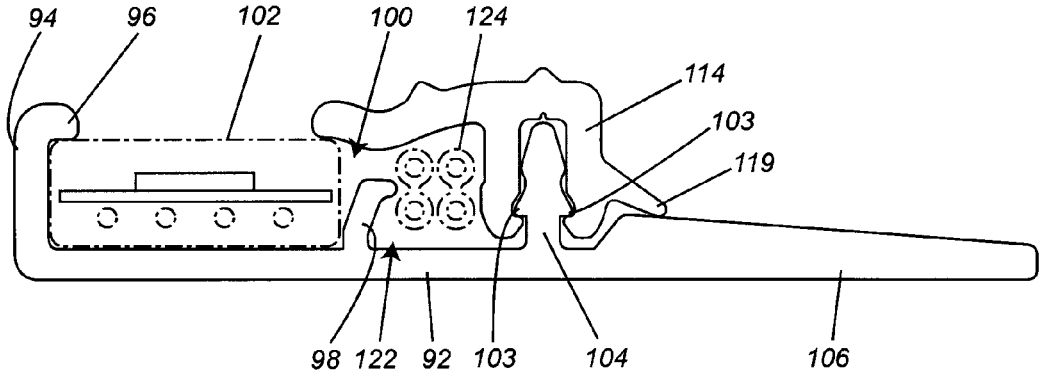
FIG. 6 is a cross-sectional view illustrating the cover of FIG. 5 in position on a base member.

In the embodiment of FIGS. 5 and 6, there is a base member 92 which has a side wall 94 and an inwardly extending lip 96. Located inwardly of side wall 94 is an upwardly extending element 98. Upwardly extending element 98, along with base member 92 and upwardly extending side wall 94 define a channel which is generally designated by reference numeral 100. Channel 100 is adapted to receive a strip of LED's 102 which are partially retained in position by inwardly extending lip 96.

Base member 92 also includes a center prong 104 having protrusions 103. A wing 106 extends outwardly at one side of base member 92.

A cover 108 includes a first prong 110 having a lip 112 and a second prong 114 having a lip 116. Prongs 110 and 114 define a recess 118 therebetween and which recesses adapt to receive and hold center prong 104. An outwardly extending flange 119 is designed to abut wing 106. A retaining portion 120 is designed to seat on an edge of LED strip 102.

In this embodiment, there is a channel 122 defined between prong 110 and upwardly extending element 98. Wires 124 may run therein to supply an adjacent or end-to-end strip of LED's if so desired.

It will be understood that the extent to which retaining portion 120 covers the strip of LED's 102 may be varied.

In some instances, the strip of LED's 102 may be of the waterproof type which is particularly adaptable for use in maritime environments.

Figure 7:
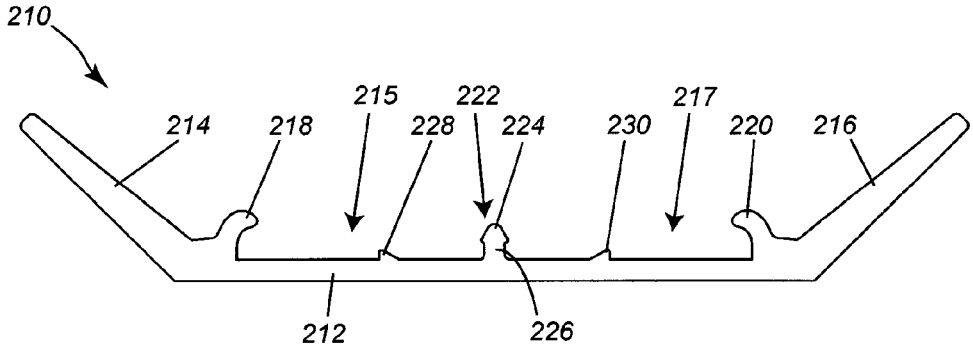
FIG. 7 is a cross-sectional view of a further embodiment of a base member.
Figure 8:
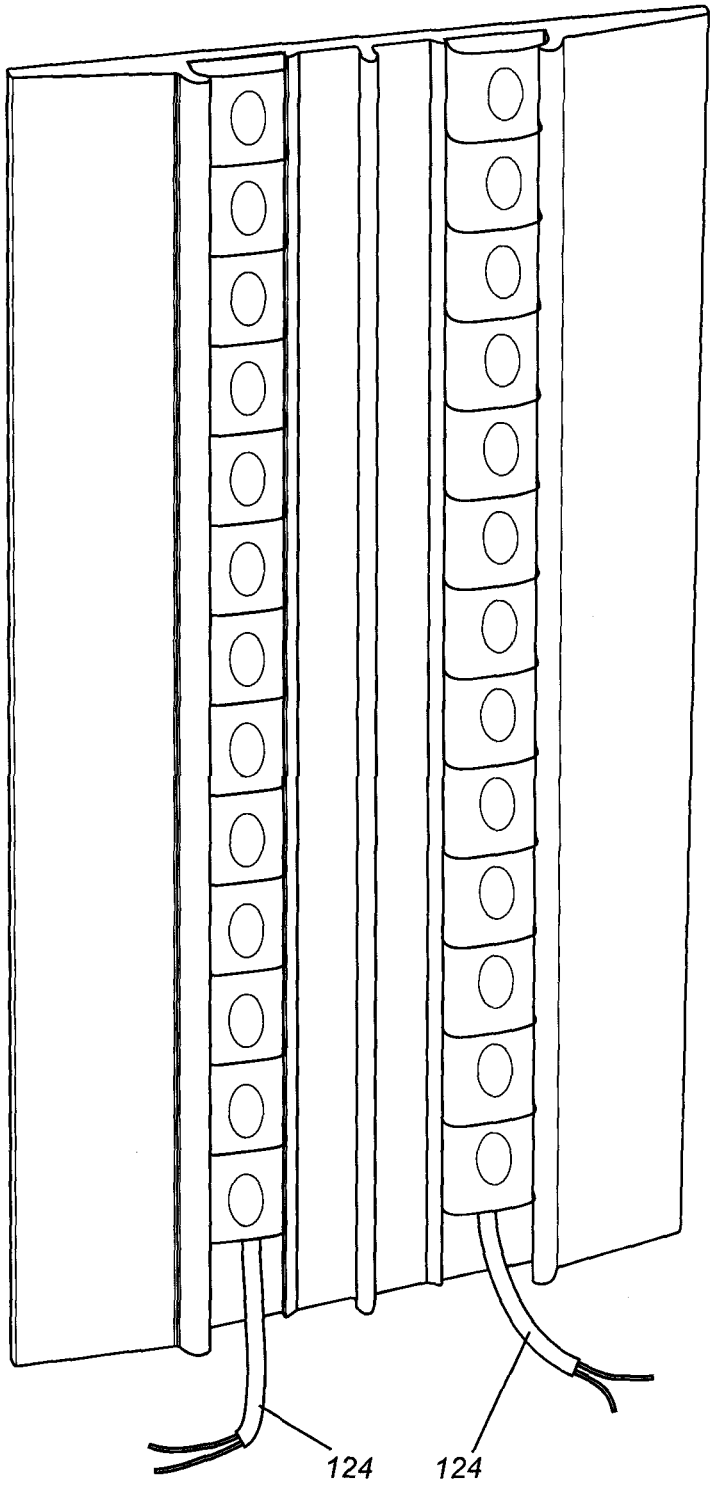
FIG. 8 is a perspective view of a lighting structure.

FIG. 7 illustrates a slightly modified version of a base member which is similar to that illustrated in FIG. 1 and thus reference numerals similar thereto, but in the 200's, are utilized. Base member 210 has a flat bottom 212 for placing adjacent to a substrate. Base member 210 includes a first wing 214 and a second wing 216 located at side extremities of base member 210. It will be noted that wing members 214 and 216 are angled with respect to bottom 212. The base member 210 could be turned upside down and wings 214 and 216 would act as protectors for the LED's.

As is the case with the previously described embodiment, formed interiorly of wing 214 is a retaining member 218 for retaining a lighting strip. A second retaining member 220 is located adjacent wing 216 and is also used for retaining a strip of LED's.

Formed centrally of the base member 210 and intermediate wings 214 and 216 is a center prong 222. Center prong 222 has an arcuate arrow shaped distal portion 224 which merges with the main portion of prong 222 by means of an undercut 226. A protrusion 228 extends upwardly from base member 210 intermediate retaining portion 218 and center prong 222; likewise, a protrusion 230 extends upwardly from base member 210 intermediate wing 216 and retaining portion 220. Channels 215 and 217 are defined by retaining members 218, 220 and center prong 222.

I claim:

1. A lighting structure for mounting a flexible strip of LED's, said lighting structure comprising:

a base member (10), a channel (15) formed within said base member (10) for receiving said flexible strip (54) of LED's;

a first portion (22) of an attachment system extending along at least a portion of said base member (10) said first portion (22) comprising an upwardly extending prong having at least one protrusion (24) extending outwardly at an upper end thereof; and a cover (34), said cover having a second portion (42, 46) of an attachment system, said second portion of said attachment system including a recess (19), said recess (19) being designed to receive said upwardly extending prong to retain said cover (34) and said base member (10) together, said cover (34) partially overlapping said channel (15) to permit retention of said flexible strip of LED's therein while leaving LED's in said strip of LED's uncovered.

2. The lighting structure of claim 1 wherein said base member (10) has first and second channels (15, 17), each channel being designed to receive a flexible strip (54, 56) of LED's, said cover (34) at least partially overlapping each of said channels (15, 17) to permit retention of respective strips of LED's.

3. The lighting structure of claim 2 wherein said base member includes first and second retaining lips (18, 20) to receive and retain a first side of a respective flexible strip (54) of LED's, respective second sides of flexible strips (54) of LED's being retained by said cover (34).

4. The lighting structure of claim 1 wherein said base member includes a retaining lip (18) to receive and retain a first side of said flexible strip (54) of LED's, a second side of said flexible strip (54) of LED's being retained by said cover.

5. The lighting structure of claim 4 wherein said base member (10) and said cover (34) are formed of a plastic material.

6. The lighting structure of claim 5 wherein said plastic material is a flexible plastic material.

7. The lighting structure of claim 5 wherein said plastic material is relatively rigid.

8. The lighting structure of claim 7 wherein said base member (212) comprises a first planar portion and second and third portions (214, 216) on respective sides of said first planar portion, said second and third portions being angled with respect to said first planar portion.

9. The lighting structure of claim 4 wherein said base member (10) includes spaced apertures to permit securement of said base member to a substrate.

10. A lighting structure comprising:

a flexible strip (102) of LED's;

a base member (92), a channel (100) formed within said base member, said flexible strip (102) of LED's being mounted in said channel (100);

a first portion (104) of an attachment system extending along at least a portion of said base member said first portion (104) of said attachment system comprising an upwardly extending element (104) having at least one protrusion extending outwardly at an upper end thereof;

a cover (108), said cover having a second portion (110, 114) of an attachment system, said second portion of said attachment system mating with said first portion of said attachment system to retain said cover (108) and said base member together said second portion of said attachment system including a recess, said recess being designed to receive said upwardly extending element;

said cover (108) at least partially overlapping said flexible strip (102) of LED's to thereby retain said strip of LED's in said channel while leaving LED's in said flexible strip uncovered.

11. The lighting structure of claim 10 wherein said base member has first and second channels (15, 17), each channel having a flexible strip (54, 56) of LED's therein, said cover (108) at least partially overlapping each of said strips of LED's to maintain said strips of LED's in a respective channel.

12. The light structure of claim 10 wherein said base member (92) and said cover (108) are formed of a plastic material.

* * * * *